United States Patent [19]

Hurko

[11] 3,987,275

[45] Oct. 19, 1976

[54] GLASS PLATE SURFACE HEATING UNIT WITH SHEATHED HEATER

[75] Inventor: Bohdan Hurko, Louisville, Ky.

[73] Assignee: General Electric Company, Louisville, Ky.

[22] Filed: Feb. 2, 1976

[21] Appl. No.: 654,451

[52] U.S. Cl. ..... 219/461; 219/349; 219/460; 219/462; 219/463; 219/464

[51] Int. Cl.[2] ..... H05B 3/68

[58] Field of Search ..... 219/347, 349, 354, 450, 219/455, 460, 461, 462, 463, 464, 467, 468

[56] References Cited

UNITED STATES PATENTS

| | | | |
|---|---|---|---|
| 1,514,628 | 11/1924 | Pritzker | 219/461 |
| 2,836,698 | 5/1958 | Fry | 219/461 X |
| 3,052,789 | 9/1962 | Trainor | 219/354 X |
| 3,172,995 | 3/1965 | Kirschke et al. | 219/463 |
| 3,335,261 | 8/1967 | Siegla et al. | 219/468 |
| 3,363,090 | 1/1968 | Langley | 219/461 X |
| 3,487,199 | 12/1969 | Hamlin | 219/399 |
| 3,539,770 | 11/1970 | Wallace | 219/461 X |
| 3,632,983 | 1/1972 | Dills | 219/464 |
| 3,733,462 | 5/1973 | Bouchard et al. | 219/464 |
| 3,789,189 | 1/1974 | Fischer et al. | 219/464 |

FOREIGN PATENTS OR APPLICATIONS

| | | | |
|---|---|---|---|
| 1,128,625 | 4/1962 | Germany | 219/461 |
| 2,164,162 | 12/1971 | Germany | 219/464 |

*Primary Examiner*—Volodymyr Y. Mayewsky
*Attorney, Agent, or Firm*—Richard L. Caslin; Francis H. Boos

[57] ABSTRACT

A flat plate surface heating unit with a glass-ceramic utensil-supporting cover plate and a metal-sheathed heating element in direct contact with the underside of the cover plate. The heating element is supported on an open framework of low thermal mass. An insulated reflector pan with a top reflective layer forms a closed housing around the heating element. The sheath is coated with a diffusion barrier of molecular film thickness, and the underside of the sheath is coated with a low emissivity coating.

10 Claims, 3 Drawing Figures

GLASS PLATE SURFACE HEATING UNIT WITH SHEATHED HEATER

BACKGROUND OF THE INVENTION

1. Field of the Invention

This invention relates to the electric range art and particularly to metal-sheathed electrical resistance heating elements for use with flat plate surface heating units and glass-ceramic plate cooktops.

2. Description of the Prior Art

Metal-sheathed electrical resistance heating elements of coiled configuration are widely used for the cooktops of electric ranges. See the Prucha/Bowling U.S. Pat. No. 3,767,897, which is assigned to the present assignee.

Smooth surface glass-ceramic cooktops have become very popular for use on both electric and gas ranges. See the Siegla U.S. Pat. No. 3,612,828 which shows a single-plate, utensil-supporting, glass-ceramic cooktop having a plurality of open coil heating elements positioned therebeneath to provide several areas for surface cooking. These open coil heaters are supported by fibrous insulation pads. In this system, the main mode of heat transfer between the open coil heater and the glass-ceramic cooktop is by radiation since the heater is vertically spaced from the cooktop by an air gap. In order to produce high radiant heat to obtain acceptable heating rates, the heater coil is operated at relatively high temperatures on the order of 1800° to 2000° F. at a wattage rating of about 2000 watts at 236 volts AC. This presents several problems. The open coil heater is in direct contact with the insulation pad, and in other commercial designs it is partially embedded into the insulation. Hence, the insulation pad operates at a very high temperature. This causes a considerable heat flow downwardly to overheat the rough-in box, as well as high heat losses, and contributes to a relatively low thermal efficiency on the order of 50 percent. Also, only a high quality, expensive insulation can be used at such high operating temperatures. Moreover, an open coil heater may be exposed, in the event the glass-ceramic were to break unintentionally. Open coil heater systems are also expensive, on the order of more than twice as expensive as standard metal-sheathed electrical resistance heating elements.

An earlier design of glass-ceramic cooktop using a metal-sheathed heating element is shown in the Dills U.S. Pat. No. 3,632,983, which is also assigned to the present assignee. This Dills patent shows a glass-ceramic cooktop including a shallow mounting or rough-in box that contains a filler plate that has recesses for accommodating the heating units and wiring raceways for containing the electrical lead wires.

The principal object of the present invention is to provide a glass-ceramic cooktop with a higher-efficiency, lower-cost, lower thermal mass, metal-sheathed heating element assembly.

A further object of the present invention is to provide a metal-sheathed heating element assembly of the class described with a molecular film diffusion barrier that protects the glass-ceramic plate from reacting with the sheath material without creating an appreciable resistance to the heat flow from the sheath to the plate.

A further object of the present invention is to provide a metal-sheathed heating assembly of the class described with means to reduce the heat losses in a downward direction from the heating element so as to improve the thermal efficiency of the heating element.

SUMMARY OF THE INVENTION

The present invention, in accordance with one form thereof, relates to a flat plate surface heating unit having a glass-ceramic cover plate and a metal-sheathed heating element in direct contact with the plate. A low thermal mass platform supports the heating element and is, in turn, supported by a reflective insulation layer which also forms a closed housing around the heating element. Spring means bias the heating element into direct contact with the cover plate.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENT

Figure 1:
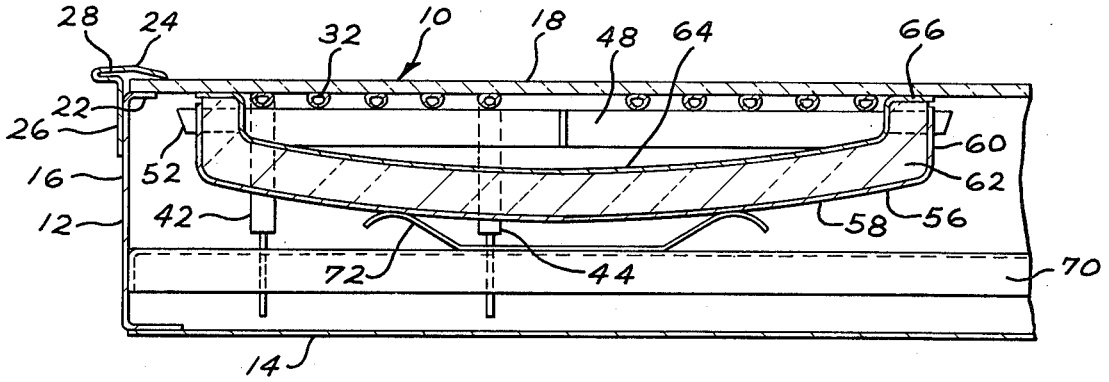
FIG. 1 is a fragmentary cross-sectional elevational view through a glass-ceramic cooktop having a metal-sheathed heating element assembly embodying the present invention.

Turning now to a consideration of the drawings, and in particular to FIG. 1, there is shown an electrically heated cooktop 10 that may either be built into a kitchen countertop or assembled over the oven of an electric range for use in the home. The cooktop 10 has a shallow mounting box or rough-in box 12 having a bottom wall, vertical side walls 16, and an open top which is adapted to be closed by a thin, utensil-supporting, glass-ceramic plate 18, which may be a large single plate or a series of either two medium plates or four smaller plates. Such glass-ceramic plate material is crystalline glass, generally opague, of milk-white appearance, of lithia-alumina-silicates having a very low coefficient of thermal expansion. Examples of such material are sold under such trademarks as PYROCERAM, CER-VIT and HERCUVIT. This glass-ceramic plate 18 has a smooth top surface of almost ground glass appearance and it is readily cleanable, and the plate does not permit the drainage of spillovers therebeneath, as in standard cooktops using coils of metal-sheathed heating elements. A peripheral ledge or flange 22 around the top edge of the box 12 serves as a support means for the glass plate, and there may be others near the center of the plate, as needed. A T-shaped trim frame 24 encircles the peripheral edge of the plate. The vertical portion 26 of the frame 24 is adapted to be fastened to the vertical walls 16 of the box. The top portion 28 of the frame has its uppermost half overlying the peripheral edge of the glass plate 18 and its outermost half adapted to overlie a peripheral edge of an opening (not shown) in a kitchen countertop when the cooktop 10 is to be built into the kitchen counter. If this cooktop were to be assembled with an electric oven to form a complete range, then the mounting means for the glass plate would be altered accordingly, as would be clear to those skilled in this art.

The cooktop 10 may have a plurality of heating means. The number of four is more or less standard in this art. For the purpose of illustrating this invention, only one heating means 32 is shown, as in FIG. 1. The heating means 32 is represented by a metal-sheathed electrical resistance heating element that is preferably of smaller sheath diameter than standard heating elements; for example, a diameter of about 0.180 inches rather than about 0.238 inches. This reduction in sheath diameter is for the purpose of reducing the thermal mass of the heating element so as to improve the thermal efficiency and speed up the heat-up and cool-down rate of the heating element.

Figure 3:
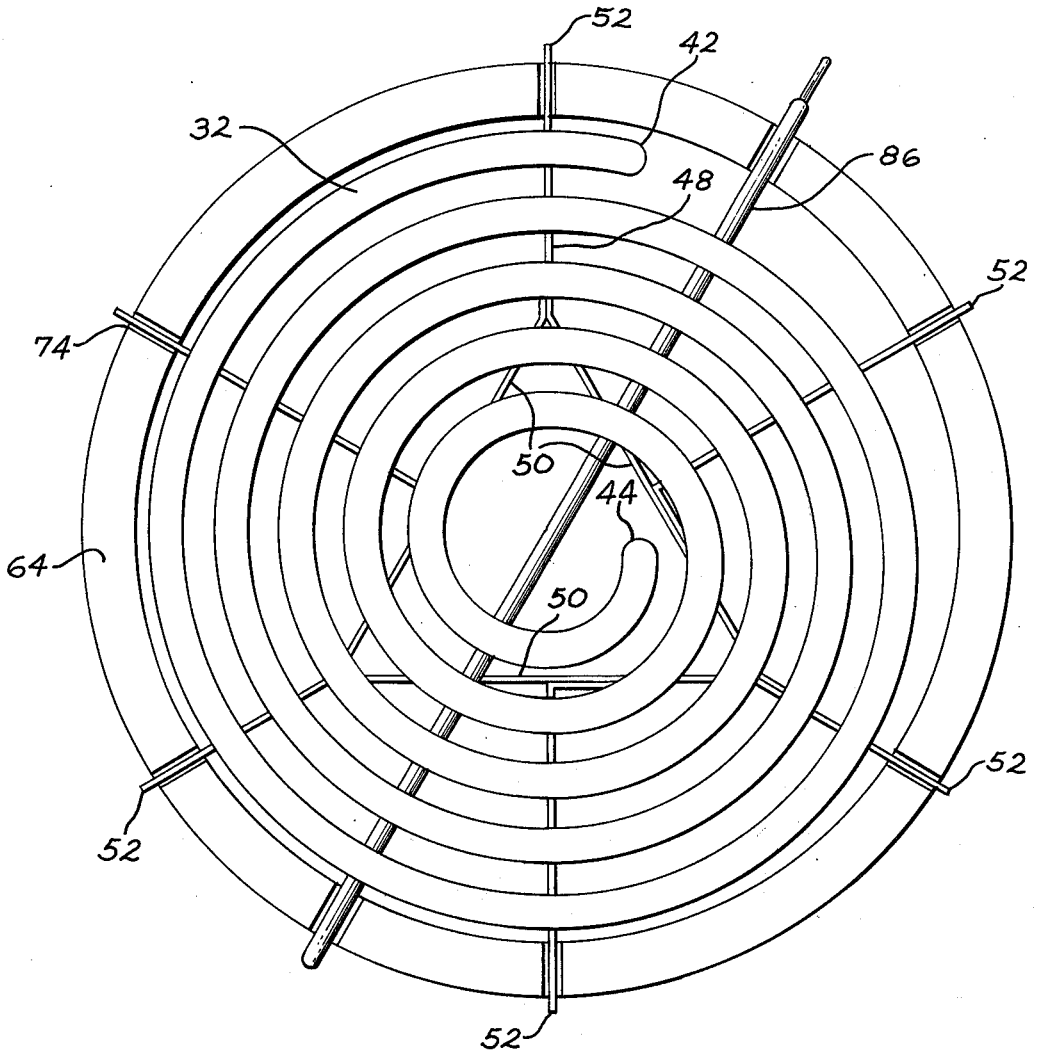
FIG. 3 is a plan view of the heating element assembly of FIG. 1 with the translucent glass plate removed.

As is standard, such heating elements have a central helix 36 of electrical resistance heater wire, such as nichrome wire, and the helix is positioned in a tubular metallic sheath 38. A layer of electrical insulation 40, that is also thermally conductive such as crystalline magnesium oxide, is compressed into the sheath 38 to separate the helix 36 from the sheath. The heating element is wound in a flat spiral coil, as is best seen in FIG. 3, and its terminal ends 42 and 44 are folded downwardly into vertical positions, as best seen in FIG. 1. Suitable electrical connections (not shown) are to be made to these terminal ends. The heating element is pressed against the underside of the glass plate 18, and, in order to have a maximum area of contact between the two, the top surface of the heating element 32 is flattened, as at 46.

The heating element 32 is supported on a low thermal mass platform 48 in the form of an open framework, commonly called a spider. As is best seen in FIG. 3, the spider is formed of a plurality of narrow metal straps which are linked together to form a triangular center portion 50 and a plurality of widely-spaced radial arms 52 which extend outwardly beyond the outermost turn of the spiral coil of the heating element 32.

The spider 48 in turn is assembled in a reflector pan 56 having a bottom wall 58 and a generally vertical side wall 60. Included in the reflector pan 56 is a layer of thermal insulation 62 which may either be of molded form or of soft fibrous material such as a fiber glass pad. In the preferred embodiment, a reflective layer 64 of aluminum foil or the like covers the top surface of the insulation 62. The main purpose of the reflector pan 56, insulating layer 62 and reflective layer 64 is to reduce the heat flow downwardly from the heating element 32 and hence reduce the heat losses to improve the thermal efficiency. Notice the insulation 62 adjacent the side wall 60 of the pan rises above the side wall, as at 66, and with the aluminum foil 64 presses against the underside of the glass plate 18 to form a sealed housing around the heating element to reduce or almost eliminate convection heat losses. The top edge of the side wall 60 of the reflector pan 56 is formed with a series of vertical slots 74 to accommodate the free ends of the radial arms 52 loosely therethrough.

The heating element assembly is supported from a beam 70 that is in turn supported at its ends from the side walls 16 of the mounting box 12. A leaf spring 72 is fastened to the top surface of the beam, and this spring is in a compressed state against the bottom surface of the reflector pan 56, which exerts an upward force that holds the heating element 32 braced against the underside of the glass plate 18 and also holds the peripheral edge of the insulation 62 with its foil liner 64 against the glass plate at 66. The sheath temperature operates at approximately 1200° F for an 8 inch diameter heating element rated at 2000 watts. In order to prevent the glass plate 18 from overheating, a single-point temperature limit control probe 86, calibrated at about 1200° F, is positioned under and pressed against the heating element 32, and it extends under the entire heater coil as is best seen in FIG. 3. The probe is filled with a high-temperature thermostatic fluid, such as sodium potassium (NAK) or the like, and the probe communicates with a temperature-responder (not shown) as is well known in the thermostat art. If a single turn of the heater coil were to experience a hot spot, the probe would sense this condition and deenergize the heating element if the temperature reached the calibration temperature of the probe.

In the before-mentioned Dills U.S. Pat. No. 3,632,983, the top surface of the heating element is provided with a high emissivity ceramic layer so as to separate the metal sheath from the glass-ceramic plate and to protect the glass-ceramic plate from the oxides of the metal sheath at the high operating temperatures. A suitable ceramic layer is given as porcelain enamel or other inert materials.

Figure 2:
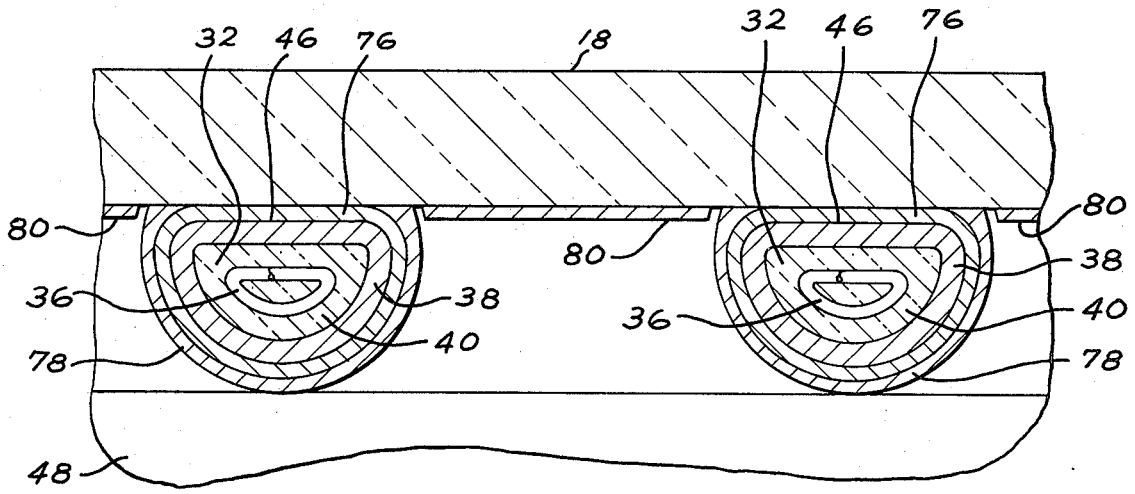
FIG. 2 is a fragmentary view, on an enlarged scale, of a portion of FIG. 1, to show the diffusion barrier covering the sheath of the heating element and the low emissivity coating on both the underside of the heating element and on the underside of the glass plate.

In the present invention, a diffusion barrier in the form of a molecular thickness film 76 coats the sheath 38 of the heating element 32, as is best seen in FIG. 2. A preferred film material is cerium dioxide. This film 76 is extremely thin, on the order of 100 angstrom units or less. This molecular film is an improvement over the ceramic or porcelain enamel coatings of the before-mentioned Dills patent because it does not form a heat flow barrier and it does not add to the thermal mass of the heating element assembly. The prior art diffusion barriers of ceramic or porcelain enamel were relatively thick, on the order of 0.005 to 0.010 inches.

Another improvement in operation is obtained with the addition of a low emissivity reflective coating 78, such as gold, palladium, or silver, on the undersurface of the diffusion barrier 76. Moreover, a similar low emissivity reflective coating 80 is printed on the underside of the glass plate 18 in the area between the coils of the heating element 32. The low emissivity coatings 78 and 80 also serve to reduce the downward heat loss and improve the overall thermal efficiency by 2 to 3 percent.

The efficiency of the system can be improved by lowering the power rating of the heating element 32. The lower wattage unit would operate at a lower maximum temperature; therefore, the heat losses and the stored heat will be reduced. Typical test results are listed below:

| Heating Unit 8" | Output Watts | Efficiency % | Time to Rise 144° F - Min. |
|---|---|---|---|
| 1 | 2000 | 65.6 | 8.1 |
| 2 | 1800 | 67.6 | 8.8 |
| 3 | 1600 | 68.9 | 9.6 |

The above test results indicate that a 1600 watt heating unit of the present invention would have the same heat-up rate or speed as prior art glass-ceramic cooktops using open coil heaters rated at 2000 watts, which have an efficiency of about 49.2 percent and a heat-up time of about 10.17 minutes to raise a standard test load up 144° F above room temperature to boiling temperature of 212° F. If the heating element had a porcelain enamel diffusion barrier instead of the molecular film 76, then it would take a 1700 watt heating element to equal a 2000 watt open coil heater.

Modifications of this invention will occur to those skilled in this art; therefore, it is to be understood that this invention is not limited to the particular embodiments disclosed but that it is intended to cover all modifications which are within the true spirit and scope of this invention as claimed.

What is claimed is:

1. A flat plate surface heating unit comprising:

a mounting box open at the top;

an upper utensil-supporting cover plate of high resistivity dielectric material such as crystalline glass positioned over the top of the mounting box;

a metal sheathed electrical resistance heating element provided with a molecular film diffusion barrier of high emissivity and low thermal mass to be in direct contact with the underside of said cover plate;

a low thermal mass metal platform supporting the heating element;

a recessed reflector pan for supporting the heating element and its platform;

a layer of thermal insulation positioned within the reflector pan beneath the supporting platform, the said layer of insulation being in close proximity to the heating element and to the said cover plate so as to form a substantially closed insulated housing around the heating element and prevent convection heat losses from the heating element;

a reflective surface formed on the top surface of the insulation layer; and spring means positioned between the mounting box and the reflector pan for biasing the heating element into firm contact with the said cover plate.

2. The invention of claim 1 wherein the said molecular film diffusion barrier is cerium dioxide having a thickness not exceeding about 100 angstrom units.

3. The invention of claim 2 wherein the said cerium dioxide film substantially covers the exterior sheath of the heating element, and a low emissivity coating substantially covers the bottom surface of the sheath of the heating element, said low emissivity coating being selected from a group comprising gold, palladium and silver, whereby at high temperatures the said cerium dioxide film serves to prevent an adverse reaction between the cover plate and the metal sheath of the heating element, as well as between the low emissivity coating and the metal sheath.

4. The invention of claim 3 wherein the said heating element is of coiled configuration, the underside surface of the cover plate which is free from the heating element being provided with a low emissivity coating similar to that on the underside of the heating element so as to reduce the radiant heat flow in a downward direction from the cover plate.

5. The invention of claim 1 wherein the said thin layer of a high emissivity diffusion barrier covers the sheath of the heating element, and a low emissivity coating substantially covers the bottom surface of the said sheath, whereby at high temperatures the said diffusion barrier serves to prevent diffusion of the sheath oxides into both the glass cover plate and into the low emissivity coating.

6. The invention of claim 5 wherein the said reflective surface is metal foil that overlies the top surface of the layer of insulation, and near the top peripheral edge of the reflector pan it is sandwiched between the insulation and the bottom surface of the glass cover plate.

7. The invention of claim 5 wherein the said metal-sheathed heating element is of reduced thermal mass by having a sheath of reduced diameter, the heating element also having a reduced power rating between about 1500 and 1800 watts so as to operate at lower temperatures and reduce the stored heat and the heat losses.

8. The invention of claim 1 wherein the said low thermal mass platform includes a series of widely spaced radial arms which extend outwardly beyond the heating element, and slot means formed in both the periphery of the reflector pan and in the peripheral portion of the insulation layer to accommodate the radial arms therethrough in a floating relationship, the said spring means bearing upwardly against the underside of the reflector pan to force the peripheral portion of the insulation layer into a sealing relationship with the underside of the cover plate and the heating element clamped against the underside of the cover plate.

9. The invention of claim 8 wherein the said heating element is coated with a molecular film of cerium dioxide.

10. The invention of claim 1 wherein the said heating element is of coiled configuration, and an elongated temperture sensing probe is positioned across the underside of the heating element and in direct contact therewith so as to prevent the said cover plate from experiencing a maximum sheath temperature limit above about 1200° F.

* * * * *